US007036613B2

(12) United States Patent
Burr

(10) Patent No.: US 7,036,613 B2
(45) Date of Patent: May 2, 2006

(54) LIP SEAL FOR ROLLER CONE DRILL BIT

(75) Inventor: Bruce H. Burr, Houston, TX (US)

(73) Assignee: ReedHycalog, L.P., Houston, TX (US)

( * ) Notice: Subject to any disclaimer, the term of this patent is extended or adjusted under 35 U.S.C. 154(b) by 275 days.

(21) Appl. No.: 10/605,177

(22) Filed: Sep. 12, 2003

(65) Prior Publication Data

US 2005/0056462 A1 Mar. 17, 2005

(51) Int. Cl.
*E21B 10/25* (2006.01)

(52) U.S. Cl. ..... 175/371; 175/331

(58) Field of Classification Search ..... None
See application file for complete search history.

(56) References Cited

U.S. PATENT DOCUMENTS

| | | | |
|---|---|---|---|
| 1,884,965 | A | 10/1932 | Baggett et al. |
| 3,127,942 | A | 4/1964 | Neilson |
| 3,299,973 | A | 1/1967 | Swart et al. |
| 3,397,928 | A | 8/1968 | Galle |
| 3,467,448 | A | 9/1969 | Galle |
| 3,656,764 | A | 4/1972 | Robinson |
| 3,746,405 | A | 7/1973 | Welton |
| 3,765,495 | A | 10/1973 | Murdoch et al. |
| 3,944,306 | A | 3/1976 | Neilson |
| 4,014,595 | A | 3/1977 | Dolezal |
| 4,037,673 | A | 7/1977 | Justman |
| 4,073,548 | A | 2/1978 | Walters |
| 4,156,470 | A | 5/1979 | Bodine et al. |
| 4,168,868 | A | 9/1979 | Shields |
| 4,194,795 | A | 3/1980 | Rife |
| 4,200,343 | A | 4/1980 | Highsmith |
| 4,209,890 | A | 7/1980 | Koskie, Jr. |
| 4,248,484 | A | 2/1981 | Newcomb |
| 4,253,710 | A | 3/1981 | Goodman |
| 4,256,351 | A | 3/1981 | Langford, Jr. |
| 4,277,109 | A | 7/1981 | Crow |
| 4,277,110 | A | 7/1981 | Fox |
| 4,279,316 | A | 7/1981 | Helmick |
| 4,279,450 | A | 7/1981 | Morris |
| 4,280,571 | A | 7/1981 | Fuller |
| 4,289,321 | A | 9/1981 | Cather, Jr. |
| 4,372,624 | A | 2/1983 | Neilson |
| 4,386,668 | A | 6/1983 | Parish |
| 4,404,840 | A | 9/1983 | Burr et al. |

(Continued)

FOREIGN PATENT DOCUMENTS

EP 0467871 A3 12/1992

(Continued)

OTHER PUBLICATIONS

US 5,887,981, 03/1999, Slaughter, Jr. et al. (withdrawn)

*Primary Examiner*—Zakiya W. Bates
(74) *Attorney, Agent, or Firm*—Jeffery E. Daly; Williams, Morgan & Amerson, P.C.

(57) ABSTRACT

A radial lip seal for use with roller cone drill bits is at least partially collapsed and held in place when the drill bit is subjected to hydrostatic pressure in the well bore when performing drilling operations. The drill bit and seal cooperate to form at least one void intentionally established between the outer surface of a seal recess in the bit and the outer surface of the lip seal. The drill bit has a spindle and a rolling cutter positioned around the spindle. The seal recess is formed in the rolling cutter and has an outer surface to carry the lip seal.

58 Claims, 4 Drawing Sheets

U.S. PATENT DOCUMENTS

| | | | |
|---|---|---|---|
| 4,428,588 | A | 1/1984 | Oelke |
| 4,428,687 | A | 1/1984 | Zahradnik |
| 4,429,854 | A | 2/1984 | Kar et al. |
| 4,430,472 | A | 2/1984 | Guzy |
| 4,452,539 | A | 6/1984 | Evans et al. |
| 4,466,621 | A | 8/1984 | Garner et al. |
| 4,496,013 | A | 1/1985 | Serpa |
| 4,515,228 | A | 5/1985 | Dolezal et al. |
| 4,519,719 | A | 5/1985 | Burr |
| 4,554,985 | A | 11/1985 | Backlund |
| 4,588,309 | A | 5/1986 | Uyehara et al. |
| 4,610,319 | A | 9/1986 | Kalsi |
| 4,613,004 | A | 9/1986 | Shotwell |
| 4,619,534 | A | 10/1986 | Daly et al. |
| 4,623,028 | A | 11/1986 | Murdoch et al. |
| 4,688,651 | A | 8/1987 | Dysart |
| 4,934,467 | A | 6/1990 | Langford, Jr. |
| 5,005,989 | A | 4/1991 | Karlsson |
| 5,027,911 | A | 7/1991 | Dysart |
| 5,129,471 | A | 7/1992 | Maurstad et al. |
| 5,137,097 | A | 8/1992 | Fernandez |
| 5,152,353 | A | 10/1992 | Denton et al. |
| 5,224,560 | A | 7/1993 | Fernandez |
| 5,230,520 | A | 7/1993 | Dietle et al. |
| 5,323,883 | A | 6/1994 | Mibe et al. |
| 5,358,061 | A | 10/1994 | Van Nguyen |
| 5,362,073 | A | 11/1994 | Upton et al. |
| 5,402,858 | A | 4/1995 | Quantz et al. |
| 5,441,120 | A | 8/1995 | Dysart |
| 5,452,771 | A | 9/1995 | Blackman et al. |
| 5,456,327 | A | 10/1995 | Denton et al. |
| 5,485,890 | A | 1/1996 | Cawthorne et al. |
| 5,513,711 | A | 5/1996 | Williams |
| 5,513,715 | A | 5/1996 | Dysart |
| 5,518,077 | A | 5/1996 | Blackman et al. |
| 5,524,718 | A | 6/1996 | Kirk et al. |
| 5,570,750 | A | 11/1996 | Williams |
| 5,644,956 | A | 7/1997 | Blackman et al. |
| 5,655,611 | A | 8/1997 | Dolezal et al. |
| 5,678,829 | A | 10/1997 | Kalsi et al. |
| 5,740,871 | A | 4/1998 | Williams |
| 5,842,700 | A | 12/1998 | Fang et al. |
| 5,842,701 | A | 12/1998 | Cawthorne et al. |
| 5,873,576 | A | 2/1999 | Dietle et al. |
| 6,033,117 | A | 3/2000 | Cariveau et al. |
| 6,142,249 | A | 11/2000 | Zahradnik et al. |
| 6,170,830 | B1 | 1/2001 | Cawthorne et al. |
| 6,173,964 | B1 | 1/2001 | Bell et al. |
| 6,179,296 | B1 | 1/2001 | Cawthorne et al. |
| 6,209,185 | B1 | 4/2001 | Scott |
| 6,247,545 | B1 | 6/2001 | Burr et al. |
| 6,254,275 | B1 | 7/2001 | Slaughter, Jr. et al. |
| 6,305,483 | B1 | 10/2001 | Portwood |
| 6,357,540 | B1 | 3/2002 | Page et al. |
| 6,474,424 | B1 | 11/2002 | Saxman |
| 6,769,500 | B1 * | 8/2004 | Miglierini ..... 175/371 |

FOREIGN PATENT DOCUMENTS

| | | | |
|---|---|---|---|
| EP | 0515780 | A1 | 12/1992 |
| GB | 2098284 | A | 11/1982 |
| GB | 2331773 | A | 6/1999 |
| GB | 2331774 | A | 6/1999 |
| GB | 2331775 | A | 6/1999 |
| GB | 2332461 | A | 6/1999 |
| WO | WO 98/15709 | A1 | 4/1998 |

* cited by examiner

LIP SEAL FOR ROLLER CONE DRILL BIT

BACKGROUND OF INVENTION

1. Field of the Invention

The present invention is generally directed to the field of sealing technology for roller cone drill bits, and, more particularly, to a radial lip seal that may be used on a roller cone drill bit.

2. Description of the Related Art

Oil and gas wells are formed by a rotary drilling process. To that end, a drill bit is mounted on the end of a drill string which may be very long, e.g., several thousand feet. At the surface, a rotary drive mechanism turns the drill string and the attached drill bit at the bottom of the hole. In some cases, a downhole motor may provide the desired rotation to the drill bit. During drilling operations, a drilling fluid (so-called drilling mud) is pumped through the drill string and back up-hole by pumps located on the surface. The purpose of the drilling fluid is to, among other things, remove the earthen cuttings resulting from the drilling process.

When the drill bit wears out or breaks during drilling, it must be brought up out of the hole. This requires a process called "tripping," wherein a heavy hoist pulls the entire drill string out of the hole in stages of, for example, about ninety feet at a time. After each stage of lifting, one "stand" of pipe is unscrewed and laid aside for reassembly (while the weight of the drill string is temporarily supported by another mechanism). Since the total weight of the drill string may be several tons, and the length of the drill string may be tens of thousands of feet, this is not a trivial job. One trip can require many man-hours and, thus, tripping is a significant expense of the drilling budget. To resume drilling, the entire process must be reversed. Thus, the bit's durability is very important to minimize the number of times a bit is replaced during drilling.

FIG. 1 depicts an exemplary rolling cutter rock drill bit 10 within which the present invention may be used. A "rolling cutter rock drill bit" is also commonly called a rock bit, a rolling cutter drill bit or an oilfield drill bit. The illustrated bit 10 includes a body 12 having three legs 14. In this type of bit, as is known in the art, a cantilevered bearing spindle (not shown in FIG. 1) formed on each leg 14 extends inwardly and downwardly and is capable of carrying a rotatably mounted rolling cutter 18. A plurality of bearings are arranged on the bearing spindle to support the rotatably mounted rolling cutter 18. Attached to each illustrated rolling cutter 18 are hard, wear-resistant cutting inserts 20, which are capable of engaging the earth to effect a drilling action and cause rotation of the rolling cutter 18.

The inserts 20 on the rolling cutters 18 crush and cut the rock as drilling operations are performed with the necessary force being supplied by the "weight-on-bit"(WOB) which presses down on the drill bit 10 and by the torque applied by the rotary drive mechanism. During the drilling process, very large and non-constant stresses and forces may be applied to the inserts 20, the rolling cutters 18, and the drill bit 10 itself. Thus, the loads carried by the internal bearings can be very large and irregularly applied. That is, the rolling cutter 18 bearings are subjected to very irregular loads, with the instantaneous loading on the bearings being several times larger than the average bearing loads.

In such drill bits, some type of seal is positioned between the bearings and the outside environment to keep lubricant around the bearings and to keep contaminants out, e.g., grit or debris resulting from the drilling process. Proper sealing is very important in drilling operations. One type of seal that may be employed in rolling cutter drill bits is a lip seal. Such a seal is positioned in a groove (or gland) formed in the body of the rolling cutter 18. The seal typically has one or more lips that engage the sealing surface of the bearing spindle. One problem with such lip seals is keeping the lip properly oriented and ensuring that all sliding takes place at the interface between the lips of the seal and the sealing surface of the bearing shaft. That is, it is desirable to ensure that substantially all sliding takes place at the lip of the seal and not at some other part of the seal that is not designed for sliding engagement with another part, and to ensure that the lip seal remains properly oriented during drilling operations.

The present invention is directed to devices and methods that may solve, or at least reduce, some or all of the aforementioned problems.

SUMMARY OF INVENTION

The present invention is generally directed to various embodiments of a radial lip seal for use with roller cone drill bits. In one illustrative embodiment, a drill bit is disclosed that is comprised of a spindle, a rolling cutter positioned around the spindle, the rolling cutter having a seal recess formed therein, the seal recess having an outer surface, and a lip seal positioned in the seal recess and around the spindle, wherein at least one void is established between the outer surface of the seal recess and the outer surface of the lip seal.

In another illustrative embodiment, the method comprises providing a drill bit comprised of a spindle, a rolling cutter positioned around the spindle, the rolling cutter having a seal recess formed therein, the seal recess having an outer surface, and a lip seal positioned in the seal recess and around the spindle, wherein at least one void is established between the outer surface of the seal recess and the outer surface of the lip seal. The method further comprises positioning the drill bit downhole, wherein the at least one void is at least partially collapsed when the drill bit is subjected to hydrostatic pressure in the well bore, and performing drilling operations with the drill bit.

BRIEF DESCRIPTION OF DRAWINGS

The invention may be understood by reference to the following description taken in conjunction with the accompanying drawings, in which like reference numerals identify like elements.

Figure 2:
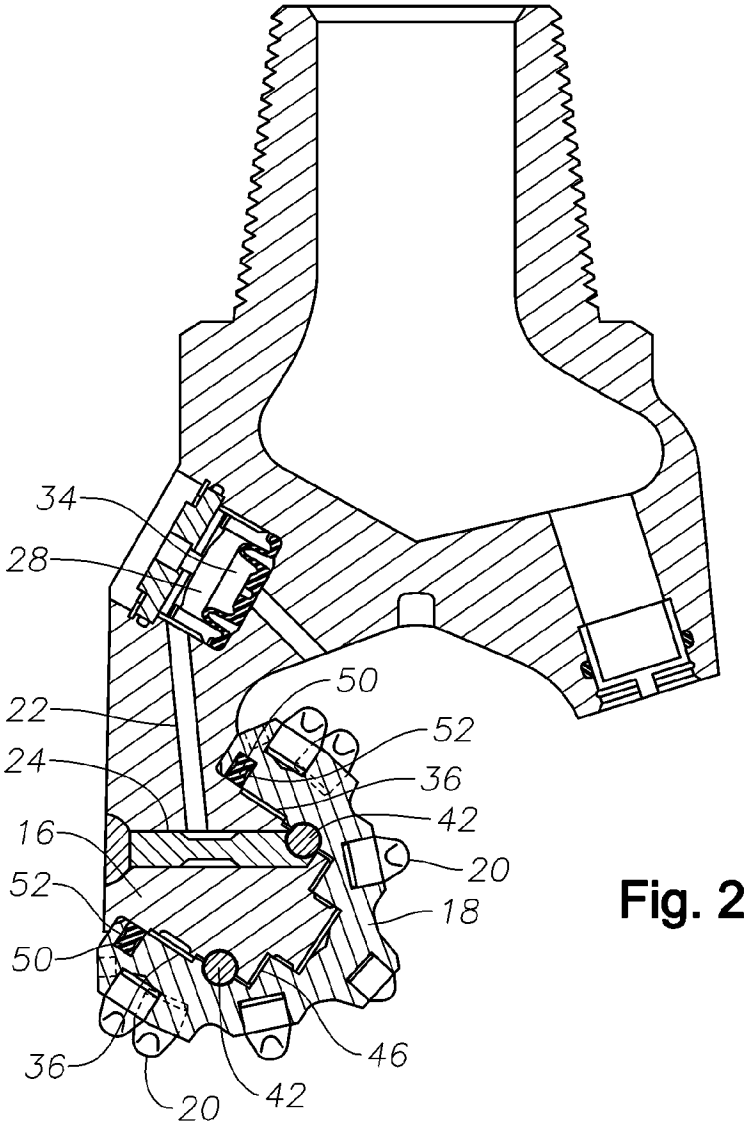
FIG. 2 is a cross-sectional view of a rolling cutter drill bit in accordance with one illustrative embodiment of the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION

Illustrative embodiments of the invention are described below. In the interest of clarity, not all features of an actual implementation are described in this specification. It will, of course, be appreciated that in the development of any such actual embodiment, numerous implementation-specific decisions must be made to achieve the developers specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The present invention will now be described with reference to the attached drawings which are included to describe and explain illustrative examples of the present invention. The words and phrases used herein should be understood and interpreted to have a meaning consistent with the understanding of those words and phrases by those skilled in the relevant art. No special definition of a term or phrase, i.e., a definition that is different from the ordinary and customary meaning as understood by those skilled in the art, is intended to be implied by consistent usage of the term or phrase herein. To the extent that a term or phrase is intended to have a special meaning, i.e., a meaning other than that understood by skilled artisans, such a special definition will be expressly set forth in the specification in a definitional manner that directly and unequivocally provides the special definition for the term or phrase.

Figure 1:
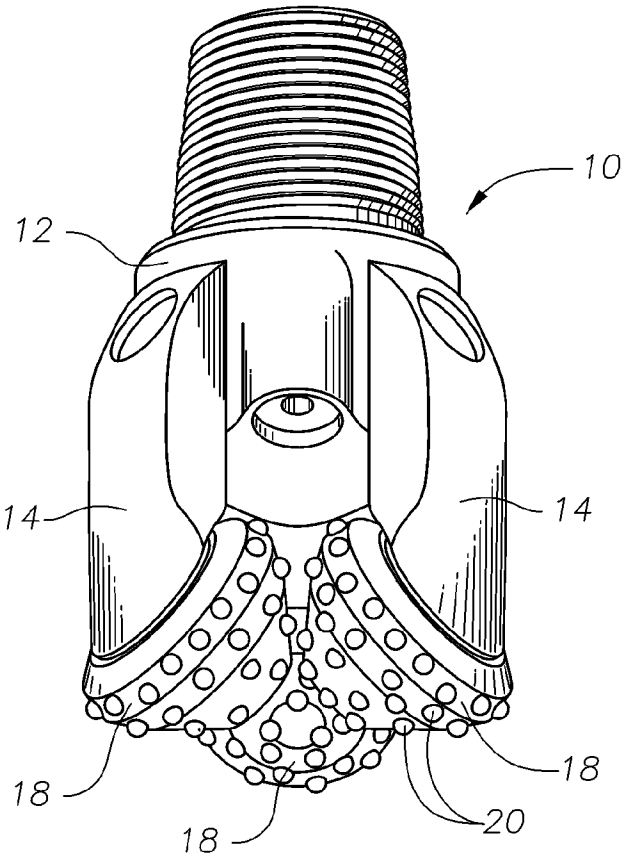
FIG. 1 is a perspective view of a rolling cutter drill bit.

Referring now to the drawings in more detail, and particularly to FIGS. 1 and 2, a rolling cutter drill bit 10 includes a body 12 (portions of which are not shown). The body 12 of a typical rolling cutter drill bit 10 comprises three similar leg portions 14 (only two are shown in FIG. 1). A cantilevered bearing spindle 16 (see FIG. 2) formed on each leg 14 extends inwardly and downwardly. A rolling cutter 18 is rotatably mounted upon the spindle 16 as hereinafter explained. Attached to the rolling cutter 18 are cutting inserts 20 which engage the earth to effect a drilling action and cause rotation of the rolling cutter 18.

Typically, each cutting insert 20 will be formed of a hard, wear-resistant material. Internal passageways 22, 24, as well as a reservoir 28, are filled with lubricant (not shown) during bit assembly. The lubricant helps reduce bearing friction and wear during bit operation and is retained within the rolling cutter 18 by a lip seal 50 in accordance with one illustrative embodiment of the present invention. Pressure differentials between the lubricant the external environment of the bit are equalized by the movement of a pressure balancing diaphragm 34.

The rolling cutter 18 is mounted upon the cantilevered bearing spindle 16 formed on the leg 14. A floating bushing 36 is mounted on the spindle 16. The floating bushing 36 is designed to carry the radial loads imposed upon the rolling cutter 18 during drilling. Also depicted are a plurality of ball bearings 42. The ball bearings 42 serve to retain the rolling cutter 18 on the bearing spindle 16 by resisting the forces which tend to push the rolling cutter 18 inward during drilling. A thrust face washer 46 is disposed between the bearing spindle 16 and the rolling cutter 18. The thrust face washer 46 carries the onward thrust forces imposed upon the rolling cutter 18 during drilling. In operation, this thrust face washer floats in the space between the bearing spindle 16 and the rolling cutter 18. It should be understood that the illustrative bearing configurations depicted in FIG. 2 are provided by way of example only, as the present invention may be employed with any type or configuration of bearings used in mounting the rolling cutter 18 on the spindle 16. Thus, the present invention should not be considered as limited to any particular arrangement or configuration of bearings unless such limitations are expressly recited in the appended claims.

Figure 3A:
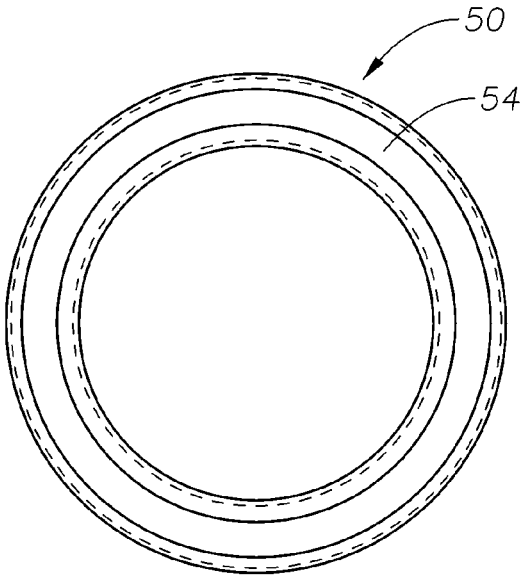
FIGS. 3A–3C are various views of a lip seal in accordance with one illustrative embodiment of the present invention.
Figure 3C:
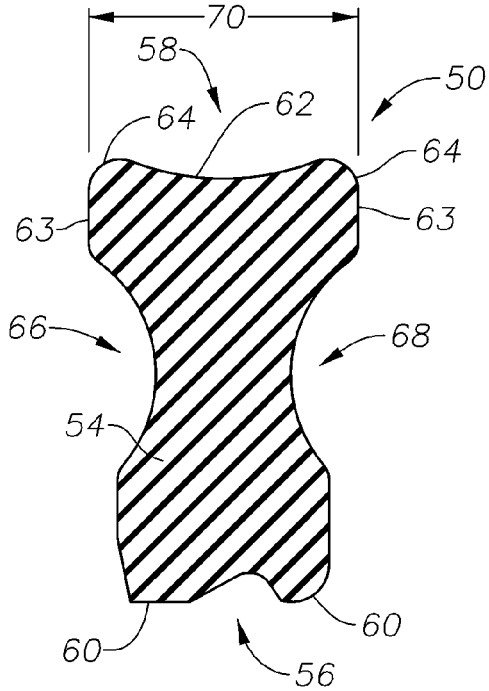
Figure 3B:
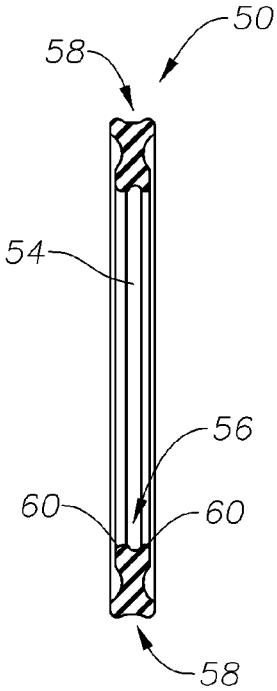
Figure 4:
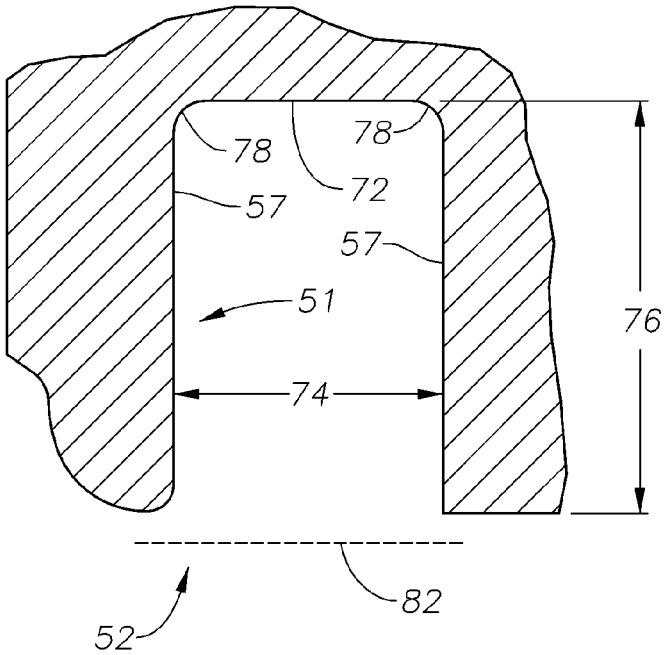
FIG. 4 is an enlarged view of an illustrative seal gland that is adapted to receive the illustrative lip seal depicted in FIGS. 3A–3C.

As indicated in FIG. 2, a lip seal 50 is positioned in a seal recess 52 (or gland) formed in the rolling cutter 18. FIGS. 3A–3C are, respectively, top, cross-sectional and enlarged, partial, cross-sectional views of an illustrative lip seal 50 in accordance with one illustrative embodiment of the present invention. FIG. 4 is an enlarged view of one illustrative embodiment of a seal recess 52 that may be employed with one embodiment of the present invention.

The lip seal 50 is generally comprised of a body 54, an inner surface 56 and an outer surface 58. The lip seal 50 is adapted to be positioned in the seal recess 52. The lip seal 50 is provided with one or more sealing lips 60 on the inner surface 56 of the lip seal 50. The sealing lips 60 are adapted to sealingly engage a sealing surface of the bearing spindle 16 as the rolling cutter 18 rotates around the bearing spindle 16. In the illustrative embodiment depicted herein, the sealing interface of the lip seal 50 is comprised of two sealing lips 60. However, as will be recognized by those skilled in the art after a complete reading of the present application, the present invention may be employed with a lip seal 50 that has any desired configuration at the sealing interface with the bearing spindle 16. Thus, the present invention should not be considered as limited to any particular type of configuration or structure for the sealing interface of the lip seal 50 unless such limitations are expressly set forth in the appended claims. The lip seal 50 may be comprised of a variety of materials, e.g., an elastomeric material that, in one embodiment, may have a Shore A hardness ranging from approximately 60–90 durometer, etc.

As best seen in FIG. 3C, the lip seal 50 has a body 54, an inner surface 56, an outer surface 58, a concave surface 62, side surfaces 63, and a plurality of protrusions 64 that are positioned proximate the concave surface 62. The middle portion of the body 54 of the lip seal 50 has a generally hour-glass shaped cross-sectional configuration as defined by the recesses 66, 68 formed on opposite sides of the body 54 of the lip seal 50.

In the illustrative embodiment depicted herein, the outer surface 58 of the lip seal 50 is defined, at least in part, by the concave surface 62. In the illustrative embodiment depicted herein, the concave surface 62 of the lip seal 50 is a radiused surface having a radius of curvature of approximately 0.172 inches, and it has a depth (at the center of the body) of approximately 0.020 inches. As will be recognized by those skilled in the art after a complete reading of the present application, the radiused concave surface 62 is provided by way of example only. That is, the present invention is not limited to use with such a radiused concave surface 62. Thus, the present invention should not be considered as limited to lip seals 50 having such a radiused concave surface unless such limitations are expressly recited in the attached claims. The overall width 70 of the body 54 of the lip seal 50 is approximately 0.255 inches. In the depicted embodiment, the protrusions 64 have a radiused surface having a radius of curvature of approximately 0.030 inches. However, the present invention should not be considered as limited to the particular disclosed configuration of the protrusions 64. The recesses 66, 68 on the sides of the lip seal 50 also have a radiused surface having a radius of curvature of approximately 0.125 inches and they have a midpoint depth of approximately 0.065 inches.

As depicted in FIG. 4, the seal groove 52 has a generally rectangular cross-sectional configuration that has an outer surface 72, a width 74 of approximately 0.249 inches and a depth 76 of approximately 0.376 inches. The seal groove 52 also has a plurality of sidewalls 57. In the disclosed embodiment, the recess 52 is provided with radiused corners 78 having, for example, a radius of approximately 0.030 inches. Of course, the cross-sectional configuration of the seal groove 52, as well as the width 74 and depth 76 of the seal groove 52, may vary depending upon the particular application. Thus, the present invention should not be considered as limited to the particularly disclosed embodiment unless such limitations are expressly recited in the appended claims. Moreover, the outer surface 72 of the seal recess 52 need not be a flat surface as is depicted in FIG. 4.

The lip seal 50 is adapted to be positioned and retained in the seal groove 52. To that end, in one embodiment, the lip seal 50 and seal groove 52 are sized and configured such that there is a slight interference fit between the lip seal 50 and the seal groove 52. More specifically, in the depicted embodiment, the lip seal 50 has a width 70 of approximately 0.255 inches while the width 74 of the seal groove 52 is approximately 0.249 inches. This interference fit will allow the lip seal 50 to be positioned and retained in the seal groove 52 as the roller cutter 18 is assembled onto the bearing spindle 16 and establish a seal between the lip seal 50 and the seal recess 52. The amount of interference between the lip seal 50 and the seal groove 52 may vary depending upon the application.

Figure 5A:
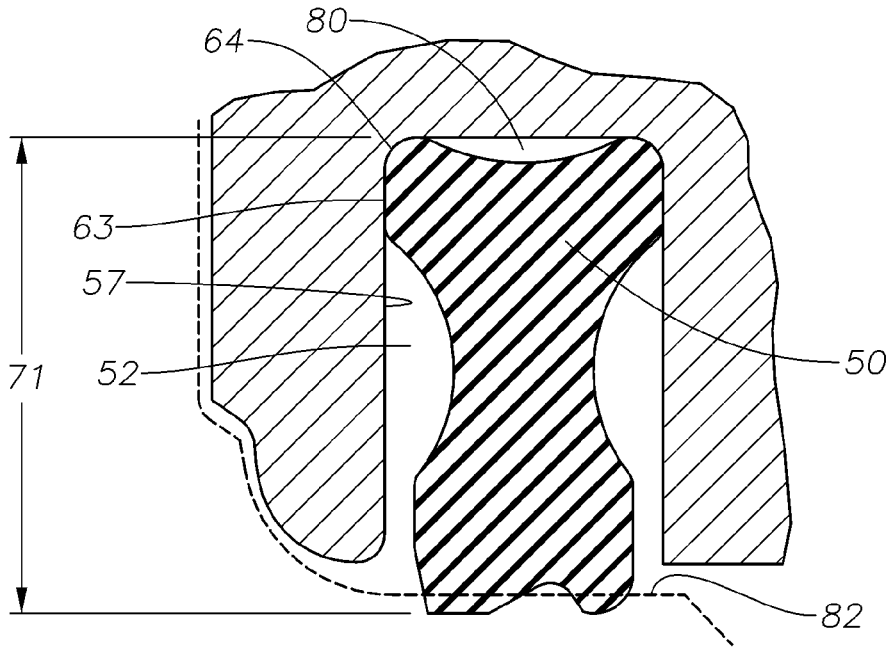
FIGS. 5A–5C are cross-sectional views depicting the lip seals at various stages of installation and when in use.
Figure 5B:
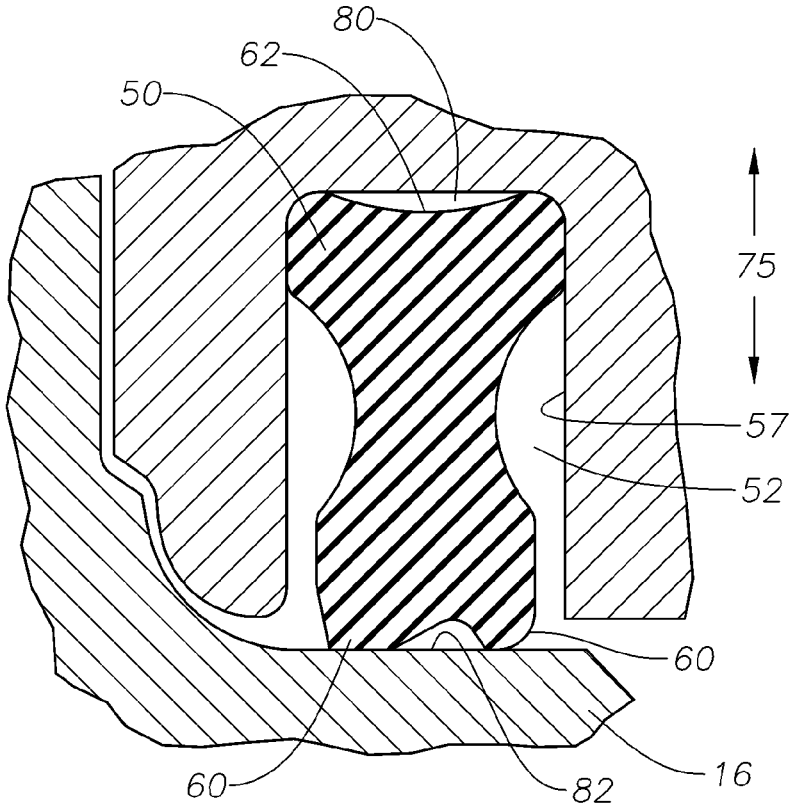
Figure 5C:
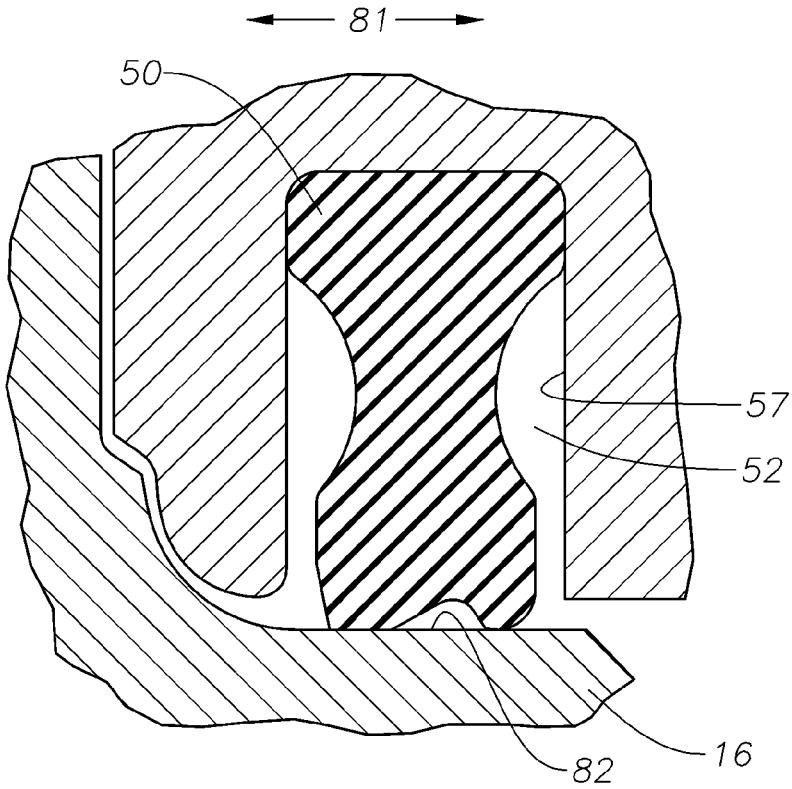

Reference will now be made to FIGS. 5A–5C to describe further aspects of the present invention. FIG. 5A depicts the situation where the lip seal 50 is initially positioned in the seal groove 52. As depicted therein, the protrusions 64 and side surfaces 63 of the lip seal 50 engage portions of the interior surface 51 of the seal groove 52. More specifically, in the depicted embodiment, the side surfaces 63 of the lip seal 50 engage portions of the sidewall 57 of the seal recess 52, while the protrusions 64 engage, at least partially, the radiused corners 78 of the seal recess 52. Note that, due to the configuration of the outer surface 58 on the lip seal 50, e.g., the concave surface 62, a void 80 is intentionally established between the body 54 of the lip seal 50 and the outer surface 72 of the seal groove 52. At the point depicted in FIG. 5A, the seal 50 is installed into the seal groove 52 under dry conditions, i.e., without lubricant. This ensures that the void 80 substantially contains only air at atmospheric pressure. The size and cross-sectional configuration (as seen in FIG. 5A) of the void 80 may vary depending upon the particular application. Moreover, a plurality of voids 80 may be provided between the outer surface 58 of the lip seal 50 and the outer surface 72 of the seal recess 52 and the cross-sectional configuration of such voids 80 may vary depending upon the particular application. In one illustrative embodiment, the void 80 (or collection of voids if more than one void 80 is employed) will have a volumetric size ranging from approximately 0.5–15 percent of the total volume of the elastomeric seal body 54. In another illustrative embodiment, the void 80 will have a volumetric size that ranges from approximately 2–6% of the total volume of the seal body. In one particularly illustrative example, the void 80 has a volumetric size of approximately 4 percent of the total volume of the seal body 54. In cases where more than one void 80 is established between the lip seal 50 and the seal recess 52, the voids 80 may each have different volumetric sizes and/or configurations. However, the volumetric size of all of the plurality of voids 80, considered commulatively, should fall within the 0.5–15% of the total volume of the seal body 54 discussed above. Thus, the present invention should not be considered as limited to the formation of a single void 80 between the lip seal 50 and the seal recess 52 unless such limitations are expressly set forth in the appended claims. Moreover, as discussed above, the present invention should not be considered as limited to voids having the volumetric size and cross-sectional configuration as depicted in the drawings, unless such limitations are expressly set forth in the appended claims. For ease of reference, the present invention will be further discussed in the context of forming a single void 80 between the seal 50 and the seal recess 52, although the invention is not limited to such an illustrative embodiment.

It is worth noting that the lip seal 50 has a radial thickness 71 that exceeds the depth 76 of the seal groove 52. A dashed line 82 in FIG. 5A indicates the position of the sealing surface 82 of the spindle 16 when the roller cutter 18 is installed on the spindle 16. Thus, when the roller cutter 18 is installed on the spindle 16, the lip seal 50 will be subjected to radial compression forces that will act to compress the seal 50 up into the seal recess 52. FIG. 5B indicates the lip seal 50 in the installed condition wherein the sealing interface, e.g., the sealing lips 60, of the lip seal 50 are engaged with the sealing surface 82 of the spindle 16. Before the roller cutter 18 is installed on the spindle 16, the inner (sealing) surface 56 of the lip seal 50 is coated with a lubricant to facilitate assembly and to facilitate smooth sliding contact between the sealing surface 82 of the spindle 16 and the sealing lips 60 on the lip seal 50. The lubricant substantially fills the entire inner surface 56. After the bit is assembled, the bearings are vacuum/pressure greased in the manner known to those skilled in the art. Note that the void 80 is still present between the outer surface 58, e.g., concave surface 62, of the lip seal 50 and the outer surface 72 of the seal groove 52 even after the rolling cutter 18 is installed on the spindle 16. As a result of the installation process, the lip seal 50 is radially compressed in the direction indicated by the double arrow 75 (see FIG. 5B). The magnitude of the radial compression on the lip seal 50 when it is position in the seal groove 52 and assembled on the spindle 16 will vary depending upon the particular application.

FIG. 5C depicts the situation after the drill bit 10 has been put in service downhole wherein the hydrostatic pressure in the well bore acts to compress the air in the void 80 between the outer surface 58 of the lip seal 50 and the outer surface 72 of the seal recess 52. Although the void 80 collapses under the hydrostatic pressure, the cavity on the inner sealing surface 56 by the hydrostatic pressure, essentially equalizing the hydrostatic pressure across the sealing lips 60. This hydrostatic pressure may be on the order of approximately 0.5–1.0 psi per foot of depth depending upon the particular application. Thus, at a depth of 5000 feet, the hydrostatic pressure would be between approximately 2500–5000 psi. When the void 80 is at least partially collapsed, or at least reduced in size, there is a wedging action or force that is exerted at least partially in the axial direction indicated by the double arrow 81 (see FIG. 5C) at the outside diameter of the lip seal 50 that tends to secure the lip seal 50 more securely within the seal recess 52. The hydrostatic pressure also tends to provide a radial force that helps secure the lip seal 50 within the seal recess 52. That is, the hydrostatic pressures that exist downhole may be used to lock in, or more securely position, the lip seal 50 in the seal recess 52. Accordingly, the present invention may be useful in reducing or preventing rotation of the lip seal 50 within the seal groove 52. As a result, the present invention may be useful in extending the effective life of the lip seal 50, thereby reducing the tendency of bearings in the rolling cutter bit 18 to prematurely fail.

Figure 6:
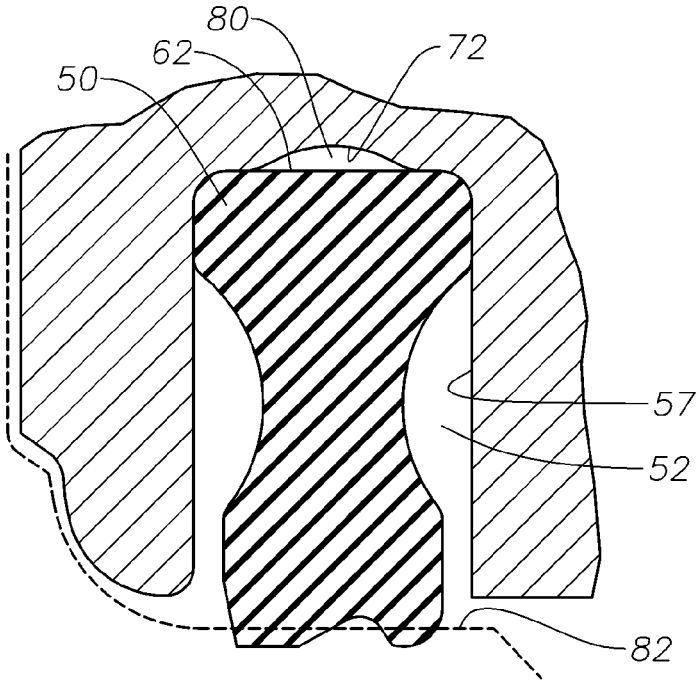
FIG. 6 depicts an alternative embodiment of a lip seal and recess in accordance with another illustrative embodiment of the present invention.

FIG. 6 depicts an alternative embodiment of the present invention. In this embodiment, the outer surface 72 of the seal recess 52 has a concave configuration, and the outer surface 62 of the lip seal 50 is a generally planar surface. In this embodiment, the void 80 is still established between the outer surface 72 of the seal recess 52 and the outer surface 62 of the lip seal 50. In the embodiment depicted in FIG. 6, the outer surface 72 is a radiused surface. However, as will be recognized by those skilled in the art after a complete reading of the present application, the outer surface 72 may be of any configuration. Moreover, the outer surface 72 may be configured such that there are a plurality of voids 80 between the lip seal 50 and the outer surface 72 of the seal recess 52.

The present invention is generally directed to various embodiments of a radial lip seal for use with rolling cutter drill bits that may be secured in place by hydrostatic pressure. In one illustrative embodiment, a drill bit is disclosed that is comprised of a spindle, a rolling cutter positioned around the spindle, the rolling cutter having a seal recess formed therein, the seal recess having an outer surface, and a lip seal positioned in the seal recess and around the spindle, wherein at least one void is established between the outer surface of the seal recess and the outer surface of the lip seal.

In another illustrative embodiment, the method comprises providing a drill bit comprised of a spindle, a rolling cutter positioned around the spindle, the rolling cutter having a seal recess formed therein, the seal recess having an outer surface, and a lip seal positioned in the seal recess and around the spindle, wherein at least one void is established between the outer surface of the seal recess and the outer surface of the lip seal. The method further comprises positioning the drill bit downhole, wherein the at least one void is at least partially collapsed when the drill bit is subjected to well bore pressure, and performing drilling operations with the drill bit.

The particular embodiments disclosed above are illustrative only, as the invention may be modified and practiced in different but equivalent manners apparent to those skilled in the art having the benefit of the teachings herein. For example, the process steps set forth above may be performed in a different order. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

What is claimed:

1. A drill bit, comprising:

a spindle;

a rolling cutter positioned around said spindle, said rolling cutter having a seal recess formed therein, said seal recess having an outer surface; and a lip seal positioned in said seal recess and around said spindle, wherein a single void is established between said outer surface of said seal recess and an outer surface of said lip seal and said lip seal and said seal recess are sized and configured to provide an interference fit between said lip seal and said seal recess when said lip seal is positioned in said seal recess.

2. The drill bit of claim 1, wherein said seal recess has a generally rectangular cross-sectional configuration.

3. The drill bit of claim 1, wherein said outer surface of said seal recess is comprised of a flat surface.

4. The drill bit of claim 1, wherein said outer surface of said seal recess is comprised of at least one concave surface.

5. The drill bit of claim 1, wherein said seal recess further comprises a plurality of corners and said lip seal is comprised of a plurality of protrusions, said protrusions adapted to at least partially engage said corners of said seal recess when said lip seal is positioned in said seal recess.

6. The drill bit of claim 1, wherein said seal recess further comprises a plurality of radiused corners and said lip seal is comprised of a plurality of radiused protrusions, said radiused protrusions adapted to engage said radiused corners of said seal recess when said lip seal is positioned in said seal recess.

7. The drill bit of claim 1, wherein said outer surface of said lip seal is comprised of at least one concave surface.

8. The drill bit of claim 1, wherein said outer surface of said lip seal is comprised of a flat surface.

9. The drill bit of claim 1, wherein said outer surface of said lip seal is comprised of at least one concave surface having a radius of curvature.

10. The drill bit of claim 1, wherein said outer surface of said lip seal is comprised of a plurality of radiused protrusions and a radiused concave surface positioned between said radiused protrusions.

11. The drill bit of claim 1, wherein said at least one void is adapted to be at least partially collapsed when said drill bit is subjected to hydrostatic pressure in a well bore.

12. The drill bit of claim 1, wherein said at least one void is adapted to be at least partially collapsed when said drill bit is subjected to hydrostatic pressure in a well bore and thereby create at least an axial force when said at least one void is at least partially collapsed that tends to secure said lip seal in said seal recess.

13. The drill bit of claim 1, wherein said lip seal is comprised of an elastomeric material.

14. The drill bit of claim 1, wherein said at least one void has a volumetric size that ranges from approximately 0.5–15% of a volumetric size of said lip seal.

15. The drill bit of claim 1, wherein said at least one void has a volumetric size that ranges from approximately 2–6% of a volumetric size of said lip seal.

16. The drill bit of claim 1, wherein said at least one void baa a volumetric size of approximately 4% of a volumetric size of said lip seal.

17. A drill bit, comprising:

a spindle;

a rolling cutter positioned around said spindle, said rolling cutter having a seal recess formed therein, said seal recess having an outer surface; and a lip seal positioned in said seal recess and around said spindle, said lip seal and said seal recess being sized and configured to provide art interference fit between said lip seal and said seal recess when said lip seal is positioned in said seal recess, wherein a single void is established between said outer surface of said seal recess and an outer surface of said lip seal, said at least one void being adapted to be at least partially collapsed when said drill bit is subjected to hydrostatic pressure in a well bore.

18. The drill bit of claim 17, wherein said seal recess has a generally rectangular cross-sectional configuration.

19. The drill bit of claim 17, wherein said outer surface of said seal recess is comprised of a flat surface.

20. The drill bit of claim 17, wherein said outer surface of said seal recess is comprised of at least one concave surface.

21. The drill bit of claim 17, wherein said seal recess further comprises a plurality of corners and said lip seal is comprised of a plurality of protrusions, said protrusions adapted to at least partially engage said corners of said seal recess when said lip seal is positioned in said seal recess.

22. The drill bit of claim 17, wherein said seal recess further comprises a plurality of radiused corners and said lip seal is comprised of a plurality of radiused protrusions, said radiused protrusions adapted to engage said radiused corners of said seal recess when said lip seal is positioned in said seal recess.

23. The drill bit of claim 17, wherein said outer surface of said lip seal is comprised of at least one concave surface.

24. The drill bit of claim 17, wherein said outer surface of said lip seal is comprised of a flat surface.

25. The drill bit of claim 17, wherein said outer surface of said lip seal is comprised of at least one concave surface having a radius of curvature.

26. The drill bit of claim 17, wherein said outer surface of said lip seal is comprised of a plurality of radiused protrusions and a radiused concave surface positioned between said radiused protrusions.

27. The drill bit of claim 17, wherein said at least one void is adapted to create at least an axial force when said at least one void is at least partially collapsed that tends to secure said lip seal in said seal recess.

28. The drill bit of claim 17, wherein said lip seal is comprised of an elastomeric material.

29. The drill bit of claim 17, wherein said at least one void has a volumetric size that ranges from approximately 0.5–15% of a volumetric size of said lip seal.

30. The drill bit of claim 17, wherein said at least one void has a volumetric size that ranges from approximately 2–6% of a volumetric size of said lip seal.

31. The drill bit of claim 17, wherein said at least one void has a volumetric size of approximately 4% of a volumetric size of said lip seal.

32. A drill bit, comprising:

a spindle;

a rolling cutter positioned around said spindle, said rolling cutter having a seal recess formed therein, said seal recess having an outer surface and a plurality of corners; and a lip seal positioned in said seal recess and around said spindle, said lip seal having at least one outer concave surface and a plurality of protrusions positioned proximate said outer concave surface, wherein said protrusions are adapted to at least partially engage said corners of said seal recess when said lip seal is positioned in said seal recess, and wherein a single void is established between said outer surface of said seal recess and said at least one outer concave surface of said lip seal.

33. The drill bit of claim 32, wherein said lip seal and said seal recess are sized and configured to provide an interference fit between said lip seal and said seal recess when said lip seal is positioned in said seal recess.

34. The drill bit of claim 32, wherein said seal recess has a generally rectangular cross-sectional configuration.

35. The drill bit of claim 32, wherein said outer surface of said seal recess is comprised of a flat surface.

36. The drill bit of claim 32, wherein said plurality of corners in said seal recess are radiused corners, and wherein said protrusions on said lip seal are radiused protrusions.

37. The drill bit of claim 32, wherein said at least one outer concave surface of said lip seal has a radius of curvature.

38. The drill bit of claim 32, wherein said at least one void is adapted to be at least partially collapsed when said drill bit is subjected to hydrostatic pressure in a well bore.

39. The drill bit of claim 32, wherein said at least one void is adapted to be at least partially collapsed when said drill bit is subjected to hydrostatic pressure in a well bore and thereby create at least an axial force when said at least one void is at least partially collapsed that tends to secure said lip seal in said seal recess.

40. The drill bit of claim 32, wherein said lip seal is comprised of an elastomeric material.

41. The drill bit of claim 32, wherein said at least one void has a volumetric size that ranges from approximately 0.5–15% of a volumetric size of said lip seal.

42. The drill bit of claim 32, wherein said at least one void has a volumetric size that ranges from approximately 2–6% of a volumetric size of said lip seal.

43. The drill bit of claim 32, wherein said at least one void has a volumetric size of approximately 4% of a volumetric size of said lip seal.

44. A methods comprising:

providing a drill bit comprised of:

a spindle;

a rolling cutter positioned around said spindle, said rolling cutter having a seal recess formed therein, said seal recess having an outer surface; and a lip seal positioned in said seal recess and around said spindle, wherein a single void is established between said outer surface of said seal recess and an outer surface of said lip seal, and wherein said lip seal and said seal recess are sized and configured to provide an interference fit between said lip seal and said seal recess when said lip seal is positioned in said seal recess;

positioning said drill bit in a well bore wherein said at least one void is at least partially collapsed when said drill bit is subjected to hydrostatic pressure in said well bore;

and performing drilling operations with said drill bit.

45. The method of claim 44, wherein said seal recess has a generally rectangular cross-sectional configuration.

46. The method of claim 44, wherein said outer surface of said seal recess is comprised of a flat surface.

47. The method of claim 44, wherein said outer surface of said seal recess is comprised of at least one concave surface.

48. The method of claim 44, wherein said seal recess further comprises a plurality of corners and said lip seal is comprised of a plurality of protrusions, said protrusions adapted to at least partially engage said corners of said seal recess when said lip seal is positioned in said seal recess.

49. The method of claim 44, wherein said seal recess further comprises a plurality of radiused corners and said lip seal is comprised of a plurality of radiused protrusions, said radiused protrusions adapted to engage said radiused corners of said seal recess when said lip seal is positioned in said seal recess.

50. The method of claim 44, wherein said outer surface of said lip seal is comprised of at least one concave surface.

51. The method of claim 44, wherein said outer surface of said lip seal is comprised of a flat surface.

52. The method of claim 44, wherein said outer surface of said lip seal is comprised of at least one concave surface having a radius of curvature.

53. The method of claim 44, wherein said outer surface of said lip seal is comprised of a plurality of radiused protrusions and a radiused concave surface positioned between said radiused protrusions.

54. The method of claim 44, wherein when said at least one void is at least partially collapsed, at least an axial force is created that tends to secure said lip seal in said seal recess.

55. The method of claim 44, wherein said lip seal is comprised of an elastomeric material.

56. The method of claim 44, wherein said at least one void has a volumetric size that ranges from approximately 0.5–15% of a volumetric size of said lip seal.

57. The method of claim 44, wherein said at least one void has a volumetric size that ranges from approximately 2–6% of a volumetric size of said lip seal.

58. The method of claim 44, wherein said at least one void has a volumetric size of approximately 4% of a volumetric size of said lip seal.

* * * * *